United States Patent [19]

Cabados et al.

[11] 4,241,741

[45] Dec. 30, 1980

[54] SPILL PROOF BONG

[76] Inventors: Rick H. Cabados, 1735 Pentuckett Ave.; Robert E. Hansen, 762 Santa Rita Rd., both of San Diego, Calif. 92109

[21] Appl. No.: 47,309

[22] Filed: Jun. 11, 1979

[51] Int. Cl.[3] ..... A24F 1/14; A24F 1/30

[52] U.S. Cl. ..... 131/173; 131/212 A; 131/210

[58] Field of Search ..... 131/173, 194, 211, 212 R, 131/212 A, 210

[56] References Cited

U.S. PATENT DOCUMENTS

| | | | |
|---|---|---|---|
| 3,881,499 | 5/1975 | McFadden et al. | 131/173 |
| 4,029,109 | 6/1977 | Kahler | 131/173 |
| 4,164,949 | 8/1979 | Diven | 131/173 |

*Primary Examiner*—Stephen C. Pellegrino
*Attorney, Agent, or Firm*—Ralph S. Branscomb

[57] ABSTRACT

A traditional bong is provided having an upright barrel divided by a partition into a lower, dry chamber into which the pipe stem enters, and an upper aqueous chamber which is made spill-proof by virtue of a stand pipe extending up from the lower chamber through the baffle, this stand pipe being covered by an elongated cap which bobbles up and down in the liquid-filled upper chamber as the device is used and seals against an opening and an overlying baffle when the bong is inverted to prevent spillage. An additional novel effect is produced by the bobbling of the diverter cap which covers the stand pipe, which tends to mix the inhaled smoke with the water as it bobbles.

4 Claims, 6 Drawing Figures

SPILL PROOF BONG

BACKGROUND OF THE INVENTION

The invention is in the field of water pipes of the variety commonly known as "bongs" which are used to smoke rare and expensive tobaccos and other exotic herbs.

A bong is a simplified version of a water pipe and is characterized in a central upright barrel, the bottom of which has a diagonal pipe stem extending therefrom with a pipe bowl on the end, such that the bottom portion of the bong barrel can be filled with water to a level below the bong bowl and above the bottom bunghole of the bong barrel. When thus prepared for smoking with the smoking substance ignited in the barrel, the user can inhale from the top of the bong and the smoke is drawn through the water in the bong bottom.

However, there are several problems inherent with the design of the traditional basic bong. The first is the seepage of the bilge in the bottom of the bong barrel up through the stem into the tobacco bowl, thus rendering the tobacco difficult to burn. Another problem resides in the vulnerability of the open-topped bong to spillage when knocked over and the incumbent mess created in the interior of the user's house.

Yet a third area which could be improved from the basic bong design is the relatively short passage of the smoke through the water or other cooling substance.

SUMMARY OF THE INVENTION

The present invention is designed to resolve the above-mentioned problems inherent in bongs of present use and provides a simply constructed bong having a dry bottom chamber which communicates with a stem and bowl of the bong pipe, an upper water chamber through which the smoke is drawn but which is maintained separate from the bottom dry chamber, a stand pipe which extends up from the partition dividing the lower chamber from the upper chamber, and a bobbling stand pipe cover tube which diverts the smoke drawn upwardly through the stand pipe back down through the water and the upper aqueous chamber.

A mounthpiece as defined in the uppermost portion of the barrel by a baffle having a central hole with a depending breather tube which is blocked off by the stand pipe diverter cap when the bong is inverted to prevent spillage, so that an ideal bong is provided, guaranteed to maintain the smoking substance dry, and yet maximize circulation and actual stirring together of the smoke and the fluid substance, and further to prevent spilling of the bong fluid in case of upset.

DETAILED DESCRIPTION OF THE DRAWING

Figure 4:
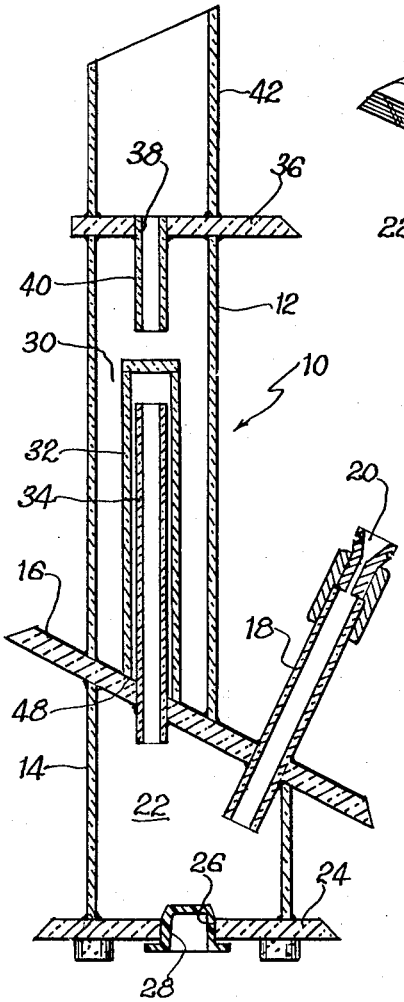
FIG. 4 is section taken along line 4—4 of FIG. 1.
Figure 5:
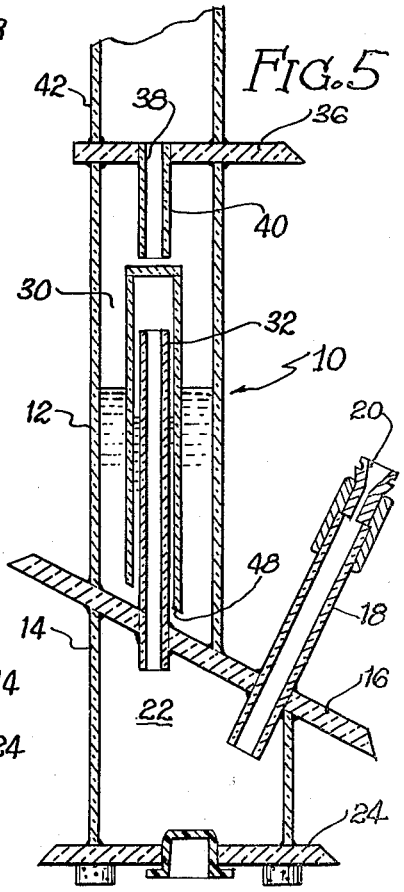
FIG. 5 is a portion of the section of FIG. 4 showing the pipe in use.
Figure 6:
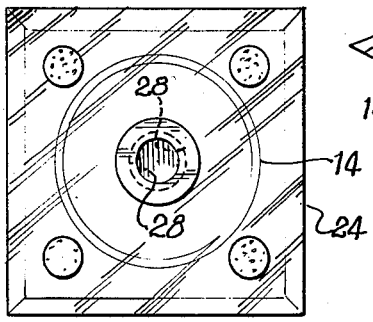
FIG. 6 is a bottom elevation view of the bong.

The bong can be seen and virtually fully understood from FIGS. 4 and 5 wherein the basic upright barrel is indicated at 10. This barrel is actually comprised of two different sized cylinders 12 and 14 which are axially eccentrically disposed one above the other as seen in FIGS. 4 and 5 and mounted in separated condition by means of a partition 16 which is slashed across the barrel at an angle to provide a space for the insertion orthogonally into the partition of the pipe stem 18. Atop the stem is a conventional bong bowl 20. Finishing off the lower chamber 22 defined in part by the lower cylinder 14 is a bottom baseplate 24 with a bung or drain hole 26 therein filled with removable plug 28.

Passing through the partition 16 from the lower chamber 22 to an upper chamber 30 defined by cylinder 12 is a stand pipe 32 which defines the only communication between the upper and lower chambers 30 and 22, and a smoke diverter such as stand pipe cap 34 is disposed loosely on the stand pipe 32.

A baffle 36 caps the chamber 22 and has a breather hole 38 therein having an optional downwardly extending breather tube 40. The baffle 36 defines an upper mouthpiece section 42 of the barrel 10 and separates same from the aqueous upper chamber 30 to prevent the spraying of the user in use and also to prevent spillage.

Turning to FIG. 5, the chamber 30 is shown partially filled with water or other liquid 44. This water level is beneath the upper end of the stand pipe 32 so that no water is permitted to enter the lower, dry chamber 22 and thus there is no chance of splashing, seepage, or spillage of any fluid up through the pipe stem 18 into the bowl 20 to foul the tobacco 46 which is being burned therein.

Figure 1:
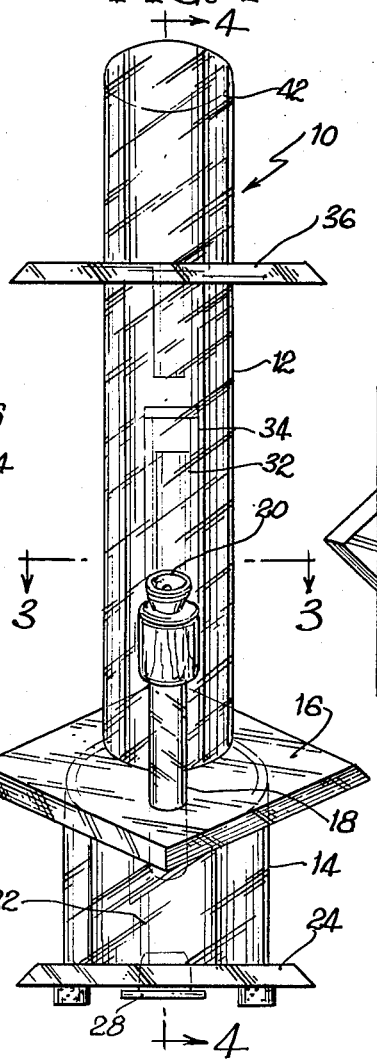
FIG. 1 is a front elevation view of the bong.
Figure 2:
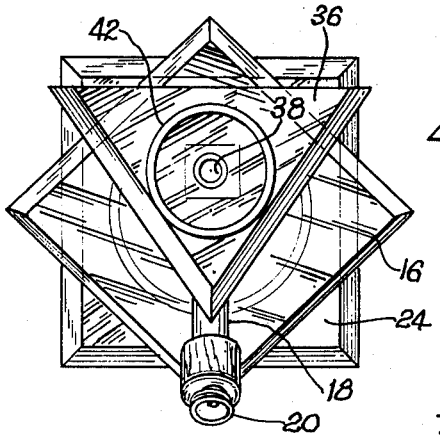
FIG. 2 is a top elevation view of the bong.
Figure 3:
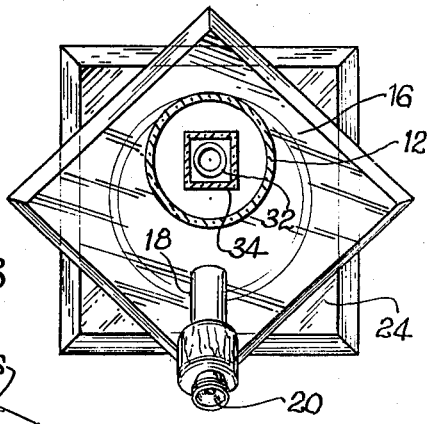
FIG. 3 is a section taken along line 3—3 of FIG. 1.

It can be noted from FIG. 3 that the cross sectional shape of the stand pipe cap 34 is square, although any other shape would work. The bottom of the cap is beveled at 48 so that when not in use the cap rests neatly on the upper surface of the partition 16 because atmospheric pressure exists both in the air of the upper chamber 30 and in the lower chamber 22.

However, upon inhaling on the mouthpiece 42, smoke is drawn in through the stem 18 into the lower chamber 22, up through the stand pipe as shown by the arrows, and is diverted by the stand pipe through water which exists in the space between the sidewalls of the stand pipe and the stand pipe cap into the lower aqueous portion of the chamber 30. Because the inhaling naturally creates a pressure differential in the upper and lower chambers, the same is expressed in the rising stand pipe cover cap 34 which bobbles up and down and the surrounding fluid as the pipe is used. Particularly because of the sharp edges of the stand pipe cap, a mixing and stirring effect on the smoke and the water is achieved.

It is also to be noted that because the stand pipe cap 34 is freely movable in a vertical direction, when the bong is inverted the stand pipe falls against the bottom edge of the breather tube 40, thus sealing off the mouthpiece and preventing any measurable spillage. In actual practice, however, the breather tube is omitted from the model illustrated, in which case the cap 34 closes the breather hole directly. In the model ordinarily constructed with the breather tube, which is a wet-bottomed model, because of the central nature of the breather tube, spillage is also restricted and would be virtually impossible provided the amount of liquid in the bong barrel is inadequate to fill the upper portion of the barrel to the height of the end of the breather tube when the device is turned upside down.

Other noteworthy features of the invention as illustrated are the shapes of the partitions 16 and the baffle 36, as well as the base member 24. Because of the non-circular, angulated shapes of these elements of the bong, once it falls over it is prevented from continuously rolling and thus continuously spilling what few drops might escape despite the spill-proof features incorporated into the device.

Other features which may be incorporated are twin upper cylinders 12 to give the invention a double-barreled effect, which would be accompanied by twin stand pipes and stand pipe caps. Obviously, variations of the shapes, sizes, and positioning of the other elements of the invention could be achieved without departing from the spirit of the invention as set forth in the above description and claimed in the claims appended below.

What is claimed is:

1. A bong comprising:

(a) an upright barrel;

(b) a partition extending across said barrel defining an aqueous chamber over said partition;

(c) a hollow stand pipe extending upwardly through said partition into said aqueous chamber such that liquid maintained in said aqueous chamber at a level below that of the top of said stand pipe will not drain through said stand pipe;

(d) a pipe bowl mounted on said barrel and means defining a smoke passageway between said bowl and the bottom of said stand pipe; and an elongated stand pipe cap covering and extending down alongside said stand pipe and communicating with the top of said stand pipe to divert any smoke traveling up through said stand pipe back down into any liquid contained in said aqueous chamber, said pipe cap being restrained by said stand pipe to substantially vertical movement and otherwise is free to bobble in the liquid in said upper chamber and responds to the drawing of smoke upwardly in said stand pipe and downwardly in said stand pipe cap.

2. The structure according to claim 1 and including a baffle across said barrel above said aqueous chamber to define a mouthpiece thereover, and said baffle includes a breather hole aligned with the vertical path of said stand pipe cap such that said hole is blocked by said stand pipe cover to prevent spillage when said bong is diverted.

3. The structure according to claim 2 and including a breather hole extension tube downwardly directed from said baffle to further guard against spillage from bong inversion.

4. The structure according to claim 2 wherein said baffle is planar and extends outwardly from said barrel to define an extended non-circular perimeter to prevent rolling of said bong about its longitudinal axis when dropped.

* * * * *